US007398654B2

(12) United States Patent
Choi et al.

(10) Patent No.: US 7,398,654 B2
(45) Date of Patent: Jul. 15, 2008

(54) AIR CONDITIONER

(75) Inventors: Dae-Hwan Choi, Busan (KR); Kyungsoo Lee, Busan (KR); Yoon-Seob Eom, Gyeongsangnam-Do (KR); Jeong-Hwan Koo, Busan (KR); Jun-Sang Ryu, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 245 days.

(21) Appl. No.: 10/539,075

(22) PCT Filed: Dec. 17, 2002

(86) PCT No.: PCT/KR02/02376

§ 371 (c)(1),
(2), (4) Date: Jun. 15, 2005

(87) PCT Pub. No.: WO2004/055441

PCT Pub. Date: Jul. 1, 2004

(65) Prior Publication Data

US 2006/0260339 A1 Nov. 23, 2006

(51) Int. Cl.
*F25D 21/04* (2006.01)

(52) U.S. Cl. ..... 62/285; 62/92

(58) Field of Classification Search ..... 62/280, 62/262, 92, 272, 285, 291
See application file for complete search history.

(56) References Cited

U.S. PATENT DOCUMENTS

| | | | | |
|---|---|---|---|---|
| 3,401,534 | A | 9/1968 | Marsteller | |
| 5,372,189 | A * | 12/1994 | Tsunekawa et al. | 62/262 |
| 6,701,737 | B2 * | 3/2004 | Ohama et al. | 62/262 |
| 6,701,738 | B2 * | 3/2004 | Kobayashi et al. | 62/262 |

FOREIGN PATENT DOCUMENTS

JP 02-93223 A 4/1990

* cited by examiner

*Primary Examiner*—Melvin Jones
(74) *Attorney, Agent, or Firm*—Birch, Stewart, Kolasach & Birch, LLP

(57) ABSTRACT

In an air conditioner, the air conditioner includes a casing having an indoor space region in which a first heat exchanger is installed and an outdoor space region in which a second heat exchanger is installed; a cross flow fan installed in the outdoor space region and generating air flow so as to make outdoor air pass the second heat exchanger and release heat to the outside; and a condensate water scattering means for scattering condensate water gathered in a bottom region of the casing to the second heat exchanger.

19 Claims, 10 Drawing Sheets

AIR CONDITIONER

TECHNICAL FIELD

The present invention relates to an air conditioner, and in particular to a single unit type air conditioner having an indoor unit and an outdoor unit as one body.

BACKGROUND ART

An air conditioner is for adjusting temperature, humidity, air current in a certain space so as to be appropriate for activity of human being and removing dust, etc. from air simultaneously.

The air conditioner consists of an indoor unit for cooling/heating indoor air and an outdoor unit for discharging/absorbing heat generated in the indoor unit to outdoors, the indoor unit and the outdoor unit can be installed separately or as one body.

In particular, an air conditioner having an indoor unit and an outdoor unit as one body is called a single unit type air conditioner or a window type air conditioner (hereinafter, it is referred to a single unit type air conditioner).

FIG. 1 is a longitudinal-sectional view illustrating the conventional single unit type air conditioner.

As depicted in FIG. 1, the conventional single unit type air conditioner includes a casing 10 having an indoor space region 21 and an outdoor space region 31 separately formed by a separation plate 11; a compressor 12 installed in the indoor space region 21 and compressing refrigerant into high temperature and high pressure state; an outdoor unit 30 being installed in the outdoor space region 31 and having a condenser 32 for cooling the refrigerant compressed by the compressor 12; and an indoor unit 20 installed in the indoor space region 21 and having an evaporator 22 performing heat exchange between the refrigerant condensed in the condenser 32 and indoor air.

A motor 13 is installed at the center of the separation plate 11, a fan 23 for generating air flow is installed at a rotational shaft 13*a* of the motor 13 in the indoor space region 21 in order to make sucked indoor air pass the evaporator 22, and a cooling fan 33 for generating air flow is installed at the rotational shaft 13*a* of the motor 13 in the outdoor space region 31 in order to make sucked outdoor air pass the condenser 32.

In general, a turbo fan is used as the fan 23, and an axial fan is used as the cooling fan 33.

In the conventional single unit type air conditioner, when power is applied, the compressor 12 compresses the refrigerant in the operation, the refrigerant compressed in the compressor 12 releases heat to the outdoor air sucked by the cooling fan 33 while passing the condenser 32, and accordingly the refrigerant is cooled.

The refrigerant cooled while passing the condenser 32 flows to the evaporator 22, performs heat exchange with the indoor air sucked by the fan 23 and cools the indoor air so as to be at a certain temperature.

Herein, condensate water is generated on the surface of the evaporator 22 while the indoor air is cooled.

The air conditioner includes a condensate water discharge unit (not shown) for discharging condensate water generated in the operation to the outside, and a flow channel (not shown) is formed at a bottom region 14 of the casing 10 in order to make the condensate water flow from the indoor space region 21 to the outdoor space region 31 smoothly.

In more detail, the condensate water condensed on the surface of the evaporator 22 flows to the bottom region 14 of the casing 10 and flows to the outdoor space region 31 along the flow channel.

The condensate water gathered in the bottom region 14 of the outdoor space region 31 is generally discharged to the outside by the condensate water discharge unit (not shown), etc. However, part of the condensate water can be scattered onto the condenser 32 by a scattering unit (not shown), etc. additionally installed or installed at the end of a wing of the cooling fan 33 in order to cool the condenser 32 more efficiently.

In the meantime, the conventional single unit type air conditioner can be installed in any space, but, it is generally installed at a window. However, because of the structure, there is a limit to adjust a width or a height of the air conditioner while securing a certain cooling performance.

In more detail, in the conventional single unit type air conditioner, because it is installed at a window, installation conditions may be intricate, in addition, it may injure the view.

TECHNICAL GIST OF THE PRESENT INVENTION

In order to solve the above-mentioned problems, it is an object of the present invention to provide an air conditioner that is capable of having a structure adjustable a height freely.

In order to achieve the above-mentioned objects, it is another object of the present invention to provide an air conditioner that is capable of adjusting a height thereof freely and cooling a condenser more efficiently by using condensate water.

In order to achieve the above-mentioned objects, an air conditioner in accordance with the present invention includes a casing having an indoor space region in which a first heat exchanger is installed and an outdoor space region in which a second heat exchanger is installed; a cross flow fan installed in the outdoor space region and generating air flow so as to make outdoor air pass the second heat exchanger and release heat to the outside; and a condensate water scattering means for scattering condensate water gathered in a bottom region of the casing to the second heat exchanger.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
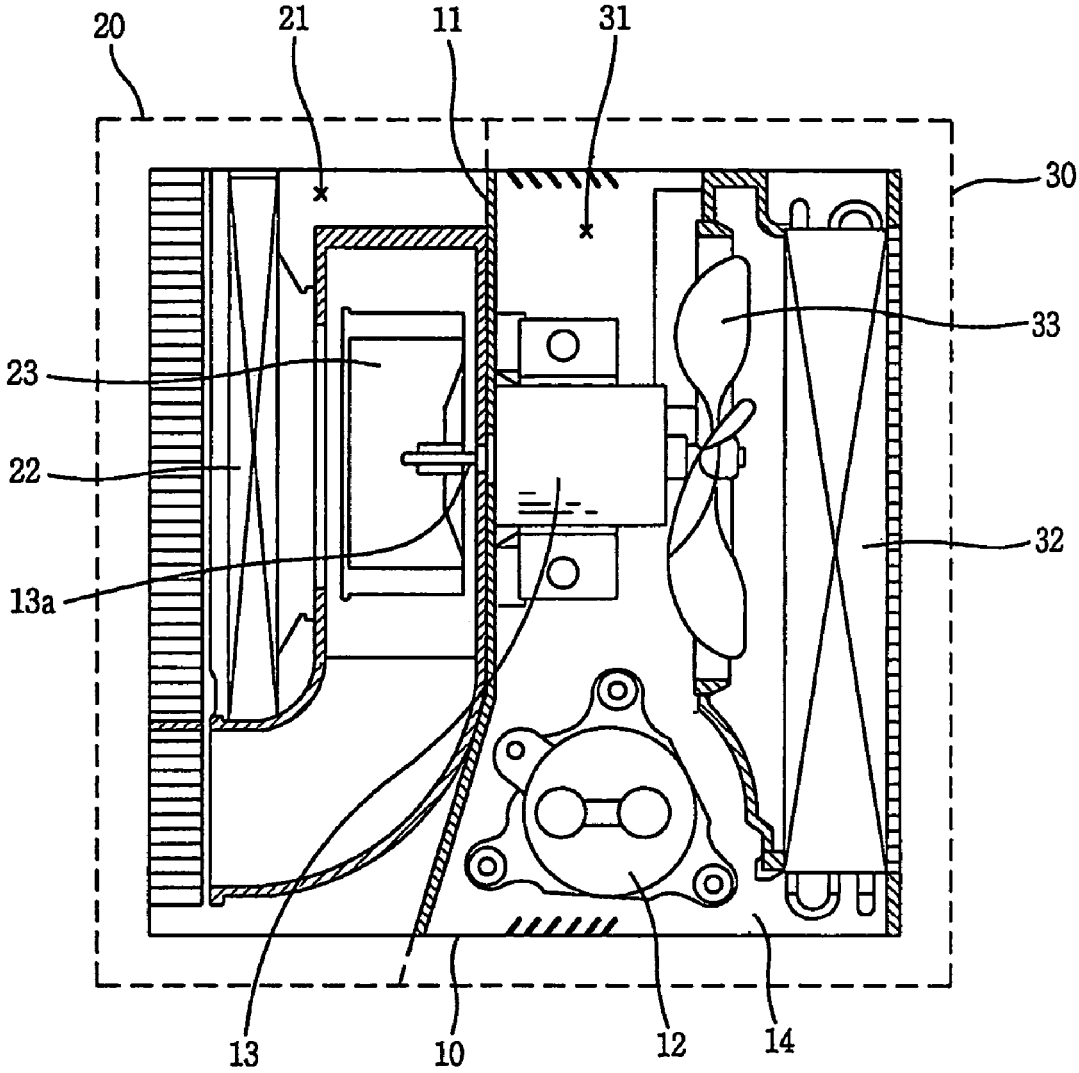
FIG. 1 is a longitudinal-sectional view illustrating the conventional single unit type air conditioner.

Hereinafter, the preferred embodiment of an air conditioner in accordance with present invention will be described in detail with reference to accompanying drawings. Construction parts same with or similar to the conventional art will have the same reference numerals, and description about them will be abridged for convenience.

The air conditioner in accordance with the present invention includes a casing 100 having an indoor space region 210 in which a first heat exchanger 20 is installed and an outdoor space region 310 in which a second heat exchanger 320 is installed; a cross flow fan 330' installed in the outdoor space region 310 and generating air flow so as to make outdoor air pass the second heat exchanger 320 and release heat to the outside; and a condensate water scattering means for scattering condensate water gathered in a bottom region 110 of the casing 100 to the second heat exchanger 320.

The first heat exchanger 220 is an evaporator constructing a refrigeration cycle and is connected to a compressor 130 installed in the casing 100 for compressing a refrigerant passing the first heat exchanger 220.

Figure 2:
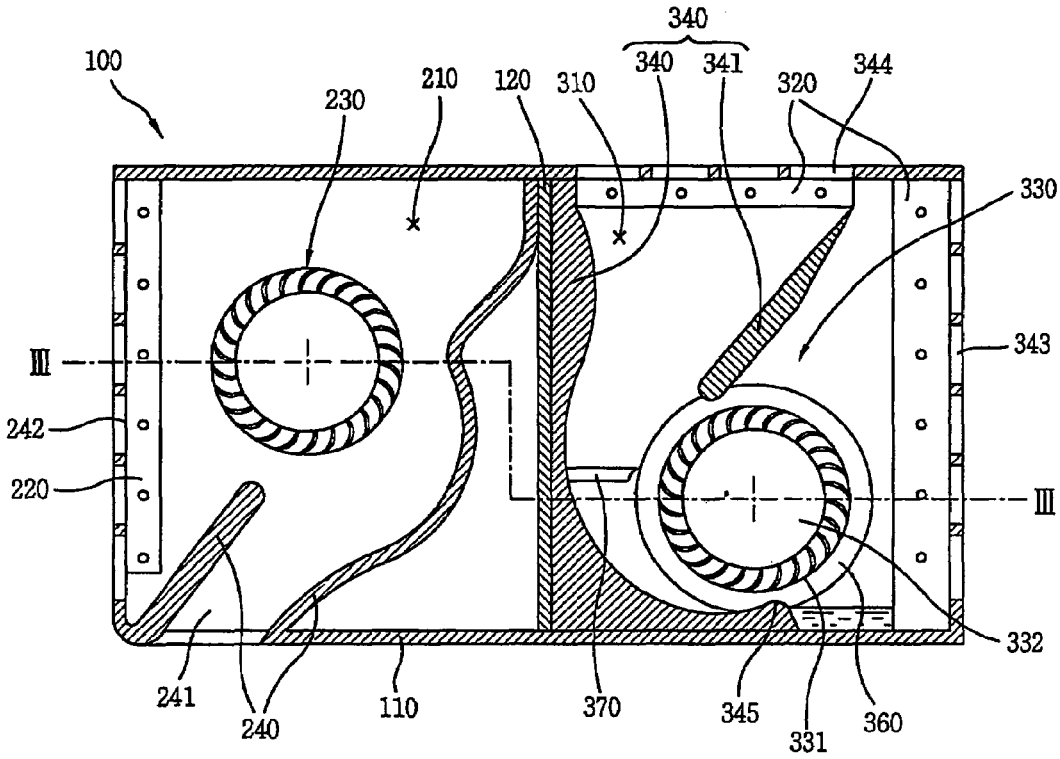
FIG. 2 is a sectional view illustrating an air conditioner in accordance with the present invention.

In the indoor space region 210 of the casing 100, a suction unit 241 for sucking indoor air with an air guide 240 for smoothing air flow in the indoor space region 310; and a discharge unit 242 for discharging the sucked air into Indoors are formed on a wall of the casing 100, as depicted in FIG. 2, the suction unit 241 is formed in the bottom region 110 of the casing 100, and the discharge unit 242 is formed at the front of the casing 100 in the direction of indoors.

And, the first heat exchanger 220 can be variously constructed according to installation shapes and positions, in the present invention, it is installed in the discharge unit 242.

In the meantime, a fan 230 is installed in the indoor space region 210 as a means for generating air flow so as to suck indoor air into the indoor space region 210 and discharge the sucked air to the room, as depicted in FIG. 2, in the present invention, a cross flow fan is used as the fan 230.

And, in the bottom region 110 of the indoor space region 210 of the casing 100, a condensate water flow channel (not shown) is formed in order to make the condensate water generated on the surface of the first heat exchanger 220 in the operation flow toward the outdoor space region 310.

In the meantime, an air guide 340 is formed in the outdoor space region 310 in order to smooth the air flow, and it includes a stabilizer 341 and a rear guide 342.

The stabilizer 341 is fixedly installed at the upper portion of the cross flow fan 330, and the rear guide 342 is installed at a separation wall 120 for dividing the casing 100 into the indoor space region 210 and the outdoor space region 310. In particular, in the rear guide 342, for improving an aerodynamic performance of the air guide 340, a protrusion portion 345 is formed at the bottom region 110 in order to make the condensate water stay between the rear guide 342 and a discharge portion 343 so as to prevent the stayed condensate water from distorting a radius of curvature of the air guide 340.

Figure 9:
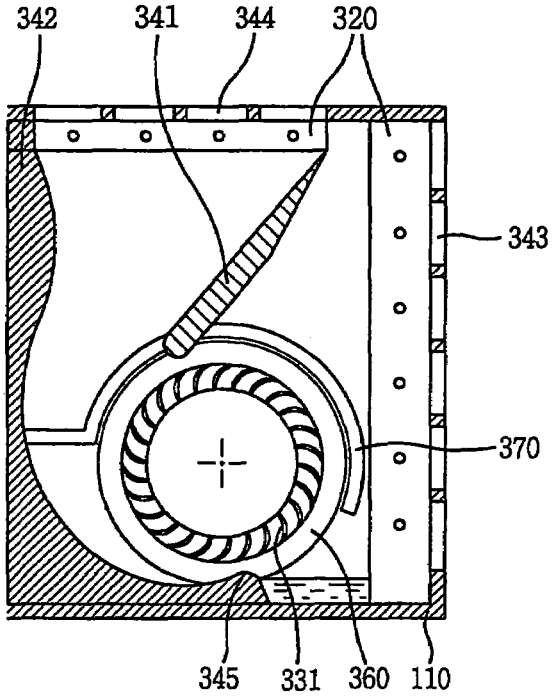
FIGS. 9 and 10 are partial sectional views illustrating modified examples of an outer space region of the air conditioner in accordance with the present invention respectively.
Figure 10:
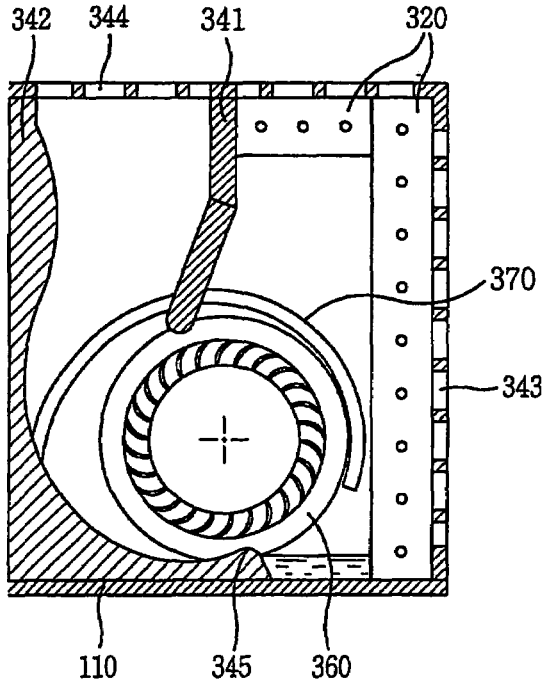
Figure 11A:
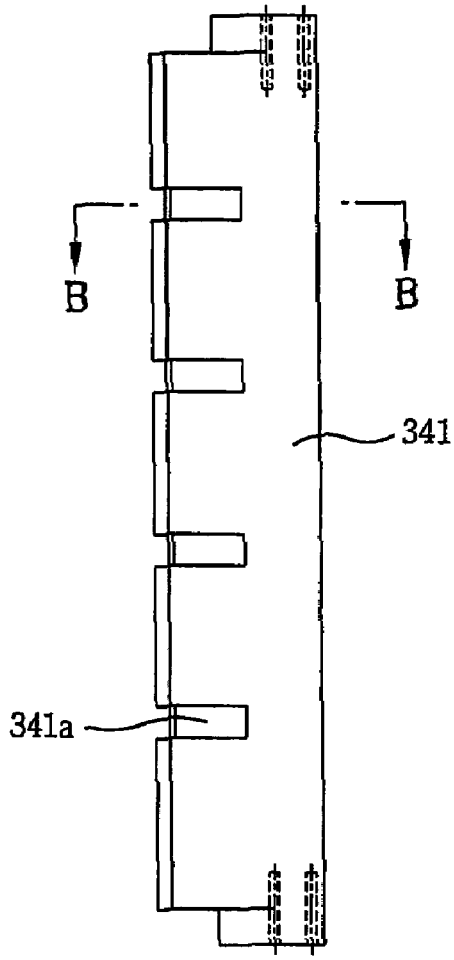
FIG. 11A is a plane view illustrating a stabilizer of the air conditioner in FIG. 2.
Figure 11B:
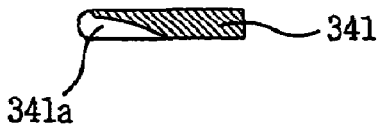
FIG. 11B is a sectional view illustrating a section of the stabilizer in FIG. 11A taken along a line B-B.
Figure 12A:
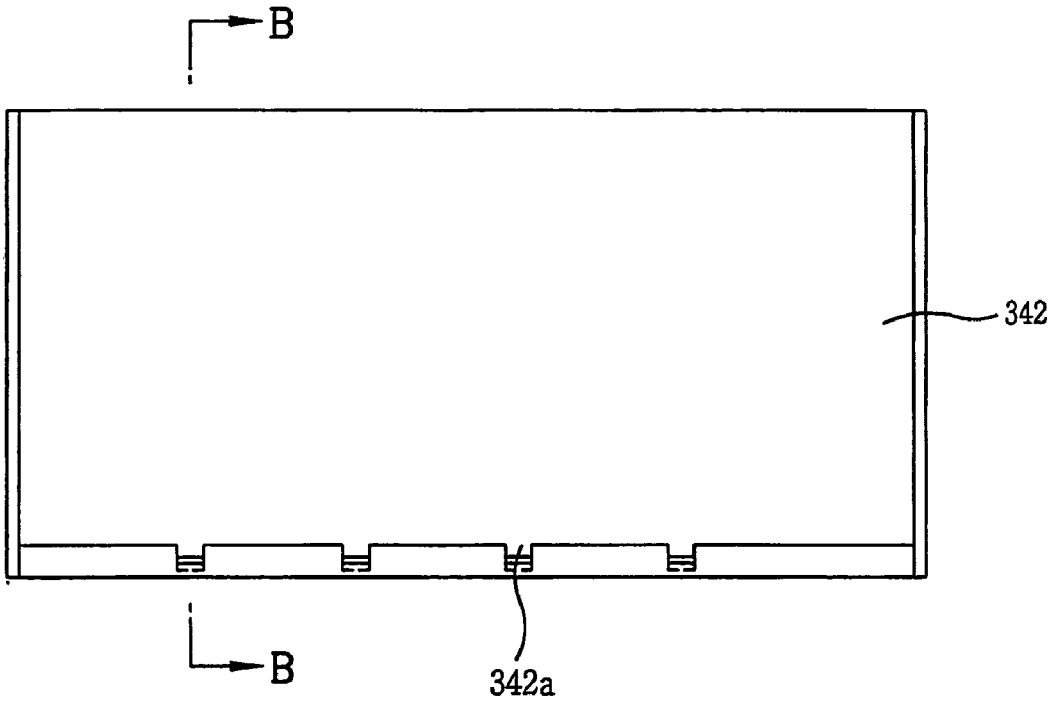
FIG. 12A is a front view illustrating a rear guide of the air conditioner in FIG. 2.
Figure 12B:
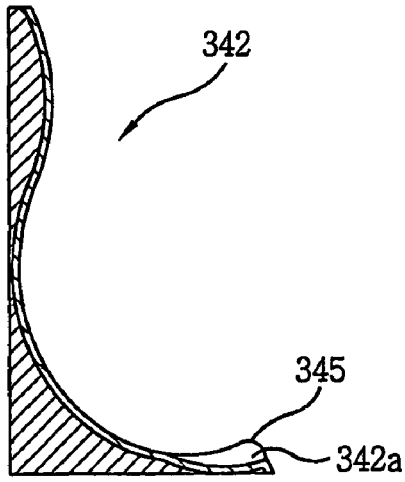
FIG. 12B is a sectional view illustrating a section of the rear guide of the air conditioner in FIG. 2 taken along a line B-B.

A section shape of the stabilizer 341 can be variously formed in case of needs, as depicted in FIGS. 9 and 10, it is fixedly installed to the casing 100.

And, in the outdoor space region 310, a suction portion 344 for sucking the outdoor air and the discharge portion 343 for sucking the indoor air are formed at the wall surface of the casing 100. As depicted in FIG. 2, in the embodiment of the present invention, the section portion 344 is formed on the upper or side surface of the casing 100, and the discharge portion 343 is formed at the front of the casing 100 toward outdoors.

The second heat exchanger 320 is a condenser constructing the refrigerant cycle, is installed in the suction portion 344 or the discharge portion 343 and is connected to the compressor 130 in order to cool the refrigerant compressed in the compressor 130 through heat exchange with the outdoor air.

Figure 3:
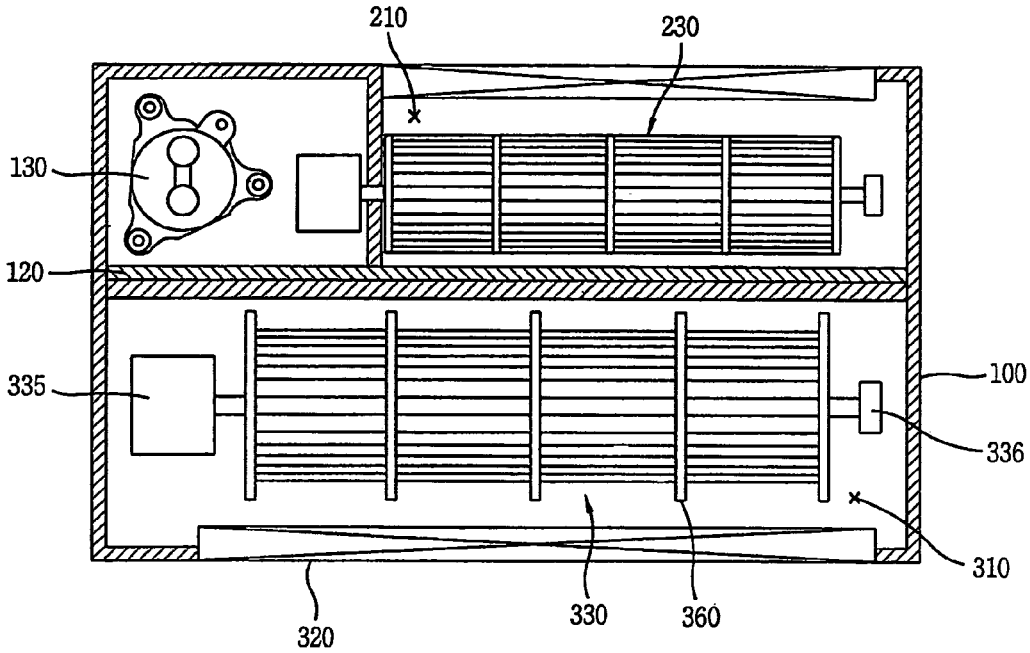
FIG. 3 is a sectional view illustrating a section of the air conditioner in FIG. 2 taken along a line III-III.
Figure 4:
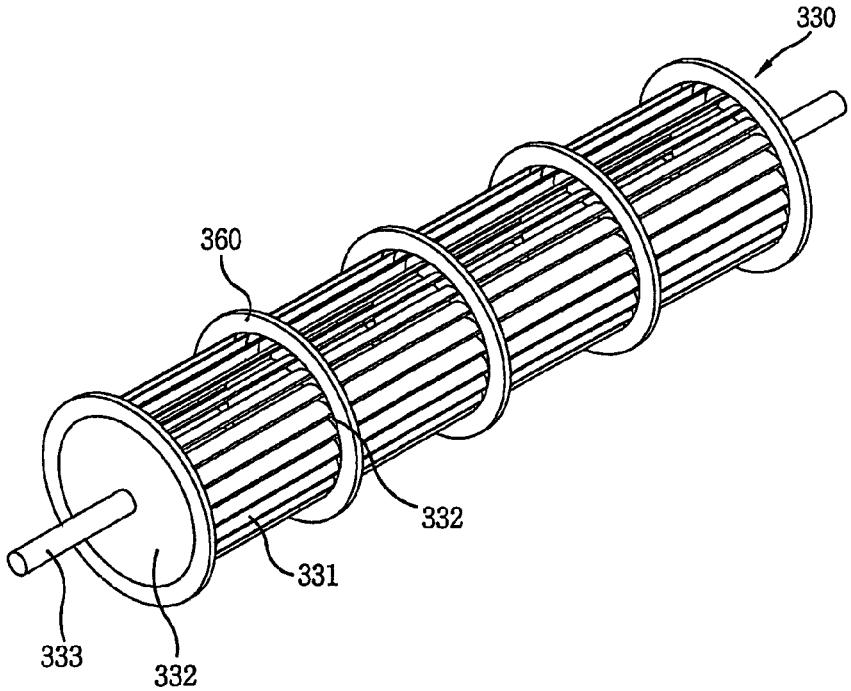
FIG. 4 is a perspective view illustrating a cross flow fan of the air conditioner in FIG. 2.

As depicted in FIGS. 3 and 4, the cross flow fan 330 for generating the air flow (sucking the outdoor air and discharging it) consists of a plurality of blades 331; and a plurality of diaphragms 332 for fixing the plurality of blades 331. Herein, the diaphragms 332 at both ends of the cross flow fan 330 are respectively combined with a rotational shaft 333.

And, an end of the rotational shaft 333 of the cross flow fan 330 is combined with a rotational shaft of a driving motor 335 installed at a certain side of the outdoor space region 310, and the other end of the rotational shaft 333 of the cross flow fan 330 is rotatably supported by a shaft supporting unit 336 fixedly installed to the bottom region 110 of the casing 100.

As depicted in FIG. 4, the condensate water scattering means consists of a plurality of slinger rings 360 respectively projected from the outer circumference of the diaphragm 332 of the cross flow fan 330.

Each slinger ring 360 is installed at each diaphragm 332 of the cross flow fan 330, or, it can be installed only at the diaphragms 332 formed at the both ends of the cross flow fan 330 in order to minimize power consumption in installation.

The slinger rings 360 are installed so as to be dip into the condensate water gathered in the bottom region 110 of the casing 100 (when the air conditioner is operated for a certain time, a certain amount of condensate water stays in the bottom region 110 of the casing 100), and accordingly the condensate water is scattered to the second heat exchanger 320 according to the rotation of the cross flow fan 330.

Figure 5:
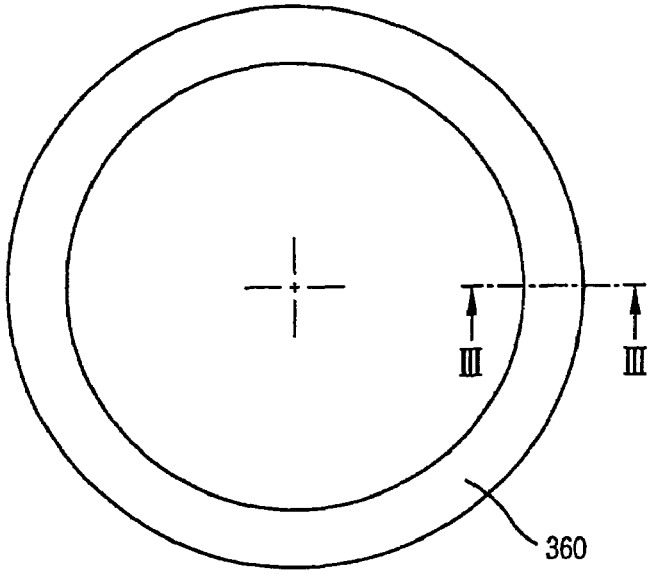
FIG. 5 is a side view illustrating an embodiment of a slinger ring of the air conditioner in FIG. 2.
Figure 6A:
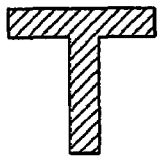
FIGS. 6A, 6B and 6C are sectional views illustrating a section of the slinger ring in FIG. 5 taken along a line VI-VI.
Figure 6B:
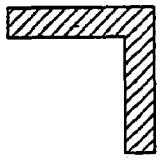

In particular, as depicted in FIGS. 5, 6A and 6B, in order to scatter the condensate water more efficiently, in a sectional shape of the slinger rings 360 in a radius direction, a width in the axial direction of the cross flow fan 330, at the end portion of the slinger ring 360 is greater than a width of a portion connected to the diaphragm 332, and it is formed as a 'T' shape and a 'L' shape.

Figure 6C:
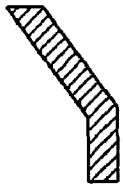
Figure 7:
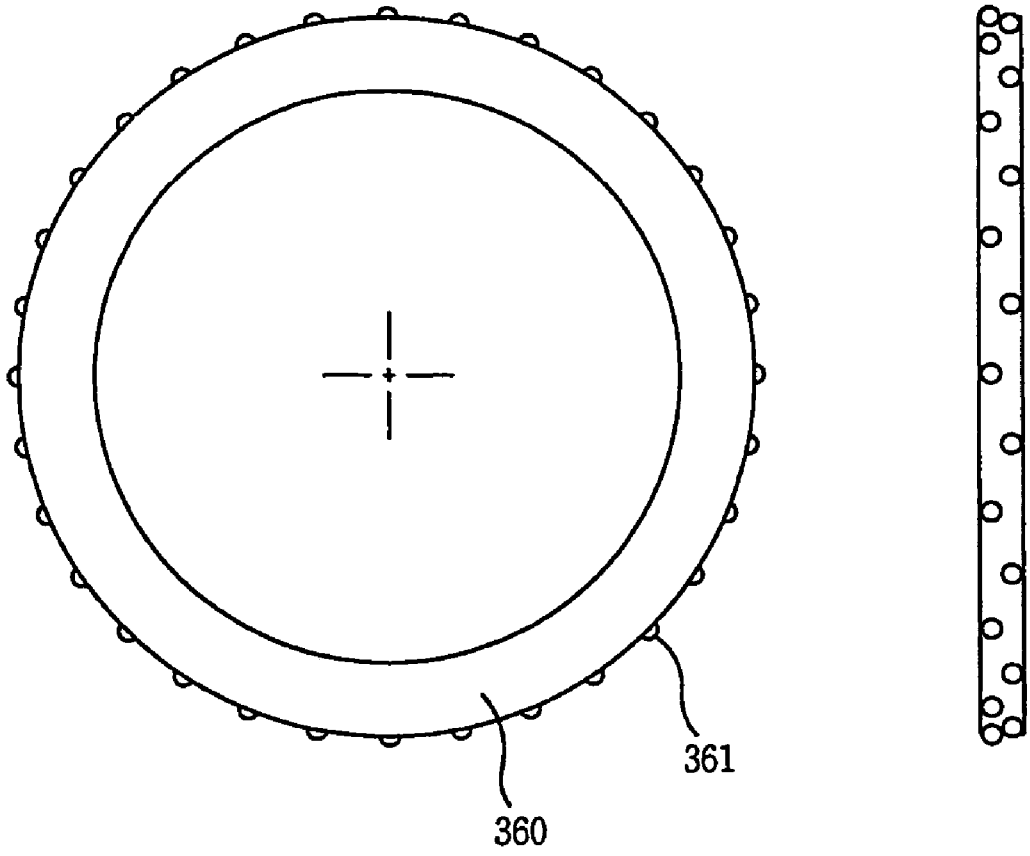
FIG. 7 is a side view and a front view illustrating another embodiment of the slinger ring in FIG. 2.

In addition, as depicted in FIG. 6C, in a sectional shape of the slinger rings 360 in the radius direction, the outer circumference portion can be curved toward the axial direction of the cross flow fan 330, as depicted in FIG. 7, a plurality of protrusions 361 can be formed at the surface of the slinger ring 360.

Figure 8A:
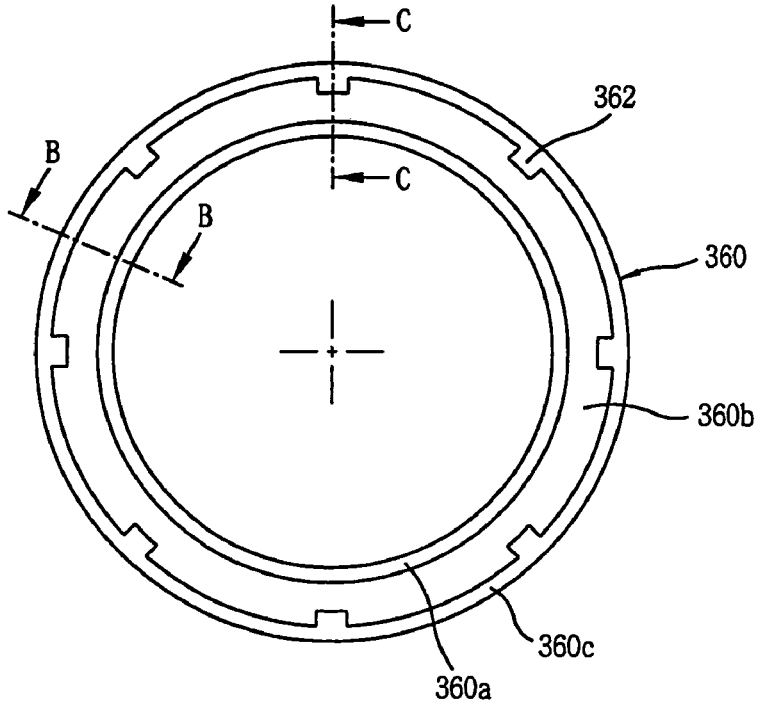
FIG. 8A is a side view illustrating yet another embodiment of the slinger ring in FIG. 2.
Figure 8B:
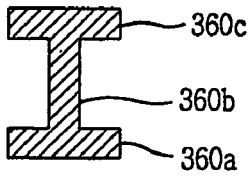
FIGS. 8B and 8C are sectional views illustrating a section of the slinger ring in FIG. 8A taken along a line B-B and a line C-C respectively.
Figure 8C:
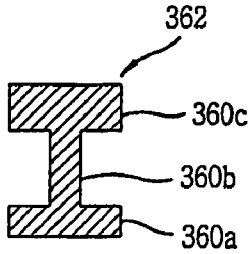

In addition, as depicted in FIGS. 8A, 8B and 8C, the slinger ring 360 consists of a connection portion 360*a* connected to the diaphragm 332; a middle portion 360*b* extended from the connection portion 360*a* having a width less than that of the connection portion 360*a* in the radius direction; and an end portion 360*c* formed at the outer circumference of the middle portion 360*b* having a width greater than that of the middle portion 360*b*.

Herein, a section of the slinger ring 360 in the radius direction has a 'H' shape. And, in the slinger ring 360, a plurality of protrusion portions 362 having a certain angle on the basis of the center of the slinger ring 360 can be formed in the circumferential direction. Herein, the end portion 360*c* is protruded inwardly at the protrusion portion 362 in the radius direction.

In the meantime, in the air guide 340 having the stabilizer 341 and the rear guide 342, the smaller a width of a portion in which the cross flow fan 330 is arranged, the more a ventilation performance is improved. For that, the stabilizer 341 and the rear guide 342 have to be arranged nearer to the cross flow fan 330.

For that, as depicted in FIGS. 11A, 11B, 12A and 12C, in the stabilizer 341 and the rear guide 342, it is preferable to be formed with grooves 341*a*, 342*a* for receiving the slinger rings 360 respectively in order to improve a ventilation performance.

In the meantime, the condensate water on the slinger ring 360 is scattered to the outside through the second heat exchanger 320 and the discharge portion 343 by the air flow, in order to prevent it, as depicted in FIGS. 9 and 10, the air conditioner in accordance with the present invention can further includes a protector 370.

The protector 370 is fixedly installed to the outdoor space region 310 in order to prevent the condensate water on the slinger ring 360 from being scattered to the outside of the casing 100 through the suction portion 344 or the discharge portion 343 by the air flow, and part of the outer circumference of the slinger ring 360 is inserted into the protector 370 with a certain air gap.

As depicted in FIGS. 9 and 10, the protector 370 can be variously installed to the casing 100.

Figure 13A:
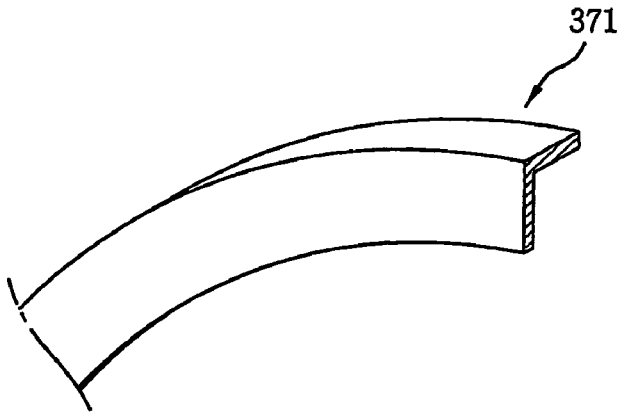
FIGS. 13A, 13B and 13C are partial sectional views illustrating examples of a section shape of a protector in FIG. 9 or 10 respectively.
Figure 13B:
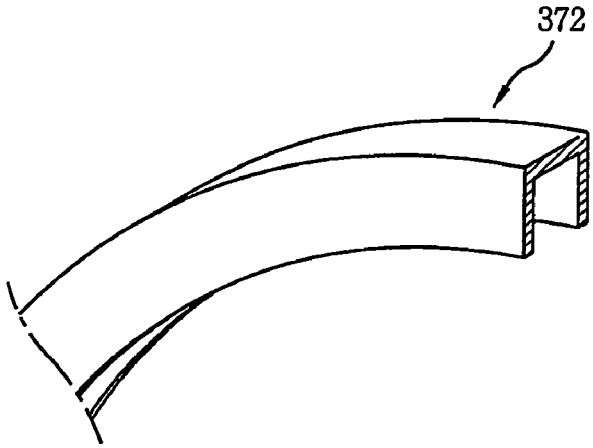
Figure 13C:
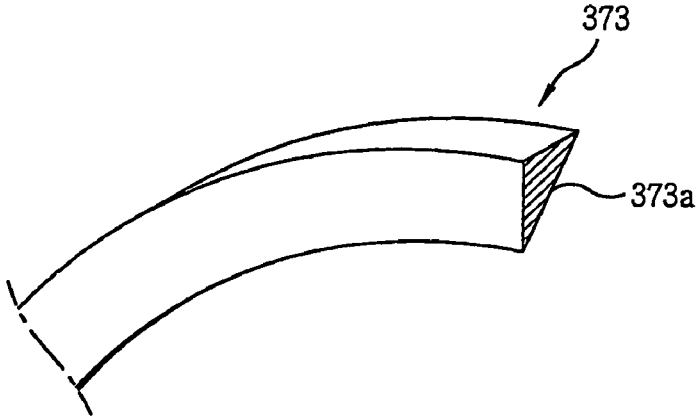

And, the protector 370 is formed as an arc shape centering around the rotational shaft 333 of the cross flow fan 330, as depicted in FIGS. 13A, 13B and 13C, a section can be formed as an 'L'0 shape, a 'U' shape or a triangular shape 371, 372, 373.

The 'L' or 'U'-shaped protector 371, 372 is installed at the slinger ring 360 at the middle portion of the cross flow fan 330 except the slinger ring 360 at the both ends of the cross flow fan 339, it prevents the condensate water on the slinger ring 360 from being scattered to the outside by the air flow, and it makes the condensate water fly to the surface of the second heat exchanger 320 by reducing a particle size of the condensate water.

The triangular-shaped protector 373 is installed at the both ends of the cross flow fan 330, and an inclined surface 373*a* is formed at the middle of the cross flow fan 330. Herein, because the condensate water crashes against the inclined surface 373*a*, a particle size of the condensate water is reduced, and accordingly the condensate water can fly toward the second heat exchanger 320.

In the meantime, in the air conditioner in accordance with the present invention, an outdoor unit of the present invention can be also applied to an air conditioner having a separated indoor unit and outdoor unit according to installation conditions of the outdoor unit.

INDUSTRIAL APPLICABILITY

In an air conditioner in accordance with the present invention, by arranging a cross flow fan in an indoor unit and an outdoor unit, a height of an air conditioner can be lowered, and accordingly it relieves installation conditions.

In addition, by installing a slinger ring at the cross flow fan, a cooling efficiency of a condenser can be improved by using condensate water generated in the operation.

The invention claimed is:

1. An air conditioner, comprising:

a casing having an indoor space region in which a first heat exchanger is installed and an outdoor space region in which a second heat exchanger is installed;

a cross flow fan installed in the outdoor space region and generating air flow so as to make outdoor air pass the second heat exchanger and release heat to the outside; and a condensate water scattering means for scattering condensate water gathered in a bottom region of the casing to the second heat exchanger, wherein the cross flow fan includes a plurality of blades and a plurality of diaphragms for fixing the blades.

2. The air conditioner of claim 1, wherein the condensate water scattering means is a plurality of slinger rings respectively protruded from the outer circumference of the diaphragms.

3. The air conditioner of claim 2, wherein the slinger rings are installed at each of the diaphragms of the cross flow fan.

4. The air conditioner of claim 2, wherein a width in a shaft direction of the cross flow fan, of the end portion of the slinger ring is greater than a width in a shaft direction of the cross flow fan, of a portion of the slinger ring connected to the diaphragm in a sectional shape of the slinger ring in the radius direction.

5. The air conditioner of claim 4, wherein a section of the slinger ring in the radius direction has a 'T' shape.

6. The air conditioner of claim 4, wherein a section of the slinger ring in the radius direction has an 'L' shape.

7. The air conditioner of claim 2, wherein a plurality of protrusions are formed at the surface of the slinger ring.

8. The air conditioner of claim 2, wherein the outer circumference portion of the slinger ring is curved toward the axis direction of the cross flow fan in a section shape of the slinger ring in the radius direction.

9. The air conditioner of claim 2, wherein a section of the slinger ring in the radius direction includes a connection portion connected to the diaphragm; a middle portion extended from the connection portion having a thickness less than that of the connection portion in the radius direction; and an end portion formed at the outer circumference of the middle portion having a thickness greater than that of the middle portion.

10. The air conditioner of claim 9, wherein a section of the slinger ring in the radius direction has an 'H' shape.

11. The air conditioner of claim 9, wherein a plurality of protrusion portions having a certain angle on the basis of the center of the slinger ring in the circumferential direction are formed at the end portion, in which the end portion is protruded inwardly at the protrusion portion in the radius direction.

12. The air conditioner of claim 2, further comprising:

a protector fixedly installed to the outdoor space region so as to receive part of the outer circumference of the slinger ring with a certain air gap in order to prevent condensate water on the slinger ring from being scattered to the outside of the casing by air flow.

13. The air conditioner of claim 12, wherein the protector has an arc shape centering around the rotational axis of the cross flow fan.

14. An air conditioner, comprising:

a casing having an indoor space region in which a first heat exchanger is installed and an outdoor space region in which a second heat exchanger is installed;

a cross flow fan installed in the outdoor space region and generating air flow so as to make outdoor air pass the second heat exchanger and release heat to the outside; and a condensate water scattering means for scattering condensate water gathered in a bottom region of the casing to the second heat exchanger, wherein the condensate water scattering means is a plurality of slinger rings respectively protruded from the outer circumference of the diaphragms.

15. The air conditioner of claim 14, wherein the slinger rings are installed at each of the diaphragms of the cross flow fan.

16. The air conditioner of claim 14, wherein a width in a shaft direction of the cross flow fan, of the end portion of the slinger ring is greater than a width in a shaft direction of the cross flow fan, of a portion of the slinger ring connected to the diaphragm in a sectional shape of the slinger ring in the radius direction.

17. The air conditioner of claim 14, wherein a plurality of protrusions are formed at the surface of the slinger ring.

18. The air conditioner of claim 14, wherein a section of the slinger ring in the radius direction includes a connection portion connected to the diaphragm; a middle portion extended from the connection portion having a thickness less than that of the connection portion in the radius direction; and an end portion formed at the outer circumference of the middle portion having a thickness greater than that of the middle portion.

19. The air conditioner of claim 14, further comprising:

a protector fixedly installed to the outdoor space region so as to receive part of the Outer circumference of the slinger ring with a certain air gap in order to prevent condensate water on the slinger ring from being scattered to the outside of the casing by air flow.

* * * * *